United States Patent [19]

Eiermann et al.

[11] 4,127,369

[45] Nov. 28, 1978

[54] PRESSURE VALVE FOR A ROTARY PISTON COMPRESSOR

[75] Inventors: Dankwart Eiermann; Otto Kraic, both of Lindau, Fed. Rep. of Germany

[73] Assignee: Wankel GmbH, Berlin, Fed. Rep. of Germany

[21] Appl. No.: 823,138

[22] Filed: Aug. 9, 1977

[30] Foreign Application Priority Data

Aug. 10, 1976 [DE] Fed. Rep. of Germany ..... 2635993

[51] Int. Cl.[2] ..... F04C 29/08; F04B 39/10; F16K 15/14

[52] U.S. Cl. ..... 418/270; 418/61 A; 417/454; 137/856

[58] Field of Search ..... 418/61 A, 252, 270, 418/181; 417/454; 137/856, 855, 853, 454.4

[56] References Cited

U.S. PATENT DOCUMENTS

| | | | |
|---|---|---|---|
| 209,525 | 10/1878 | Tonkin | 137/853 X |
| 2,934,083 | 4/1960 | Norton | 137/856 X |
| 3,036,527 | 5/1962 | Peterson | 418/252 X |
| 3,809,511 | 5/1974 | Linder et al. | 418/270 X |

FOREIGN PATENT DOCUMENTS

| | | | |
|---|---|---|---|
| 1,020,359 | 2/1966 | United Kingdom | 137/853 |

*Primary Examiner*—Carlton R. Croyle
*Assistant Examiner*—Leonard E. Smith
*Attorney, Agent, or Firm*—Walter Becker

[57] ABSTRACT

A pressure valve arranged in a rotary piston compressor which valve is mounted in a passage or bore of the housing casing of the compressor. The last mentioned passage is axis parallel to the rotary piston compressor axis. The valve has a cylindrical cross section and can be inserted into the passage or bore parallel to the compressor axis behind an outlet opening in the track of the housing casing through a side wall of the compressor. The valve seat is formed by a longitudinally slotted tubular part which exerts a radially outwardly directed resilient force. The slotted tubular part comprises segmental valve opening slots extending parallel to the side walls of the compressor. Over the slots are located valve lugs or tongues which are cut from a thin-walled tube arranged with a precise fit in the tubular part while the roots of the valve lugs or tongues are connected to the thin-walled tube. An additional tube is with precise fit inserted into the thin-walled tube. Cut out of the additional tube are stroke-limiting lugs or tongues which are located behind the valve lugs or tongues and are curved toward the interior of the thin-walled tube, the roots of the stroke-limiting lugs or tongues being connected to the additional tube.

3 Claims, 2 Drawing Figures

PRESSURE VALVE FOR A ROTARY PISTON COMPRESSOR

The invention relates to a pressure valve for a rotary piston compressor, which is mounted in an axis-parallel passage of its housing casing.

Such valves control the outlet of the medium from the working space in which compression takes place. They are closed by the already compressed, expelled medium and only open when the counter-pressure of this medium is equalled or exceeded by the rising pressure in the working chamber.

Such a valve should meet the following requirements:

a. The arrangement of the valve seat should be as close as possible to the inner wall of the housing in order to obtain a minimum dead space in the access to the valve.

b. The arrangement of the valve should be in a peripheral outlet in the housing mantle in order to avoid flow losses, otherwise making necessary its placement in the side wall.

c. The valve opening should extend over the whole track breadth in order to obtain favorable flow conditions.

d. The weakening of the housing mantle by the passage necessary for the valve should be at a minimum and the cooling of the housing by the valve arrangement should as far as possible not be impeded.

e. Finally, ready access and fitting of the valve should be assured.

Swiss patent specification No. 181,039 describes a valve for a compressor of the vane-shell construction with a circular jacket track, which is inserted laterally into a comparatively large axis-parallel bore in the housing casing. While in this connection the conditions set forth above under (c) and (d) are met, it will be appreciated that since the valve seat is close to the plane in the axial center of the hole, a large dead space results. In view of the size of the hole, however, a weakening of the housing results just in the vicinity of the highest pressure, and the space for the cooling fins is limited adjacent to the working space in the vicinity of the highest thermal load. The fitting or replacement of this valve is furthermore possible only if at least one side wall of the machine is removed which, however, requires an involved operation so that the last mentioned significant condition set forth above under (e) is not met.

German patent specifications Nos. 2 002 076 and 2 403 775 (Offenlegungsschriften) propose valves which are also inserted laterally into passages in the housing casing, whose axis runs parallel to that of the machine. While in this case the dead space is reduced to a minimum and while there is a large valve cross section of satisfactory aerodynamic design, it will be appreciated that due to the valve seat plane being located very close to the casing track, a weakening of the housing casing results. More specifically, as is the case with the subject matter of the above mentioned Swiss patent specification, such a valve can only be fitted when the side wall has been removed, which is usually not possible without removal of the compressor itself.

It is, therefore, an object of the present invention to avoid the above mentioned drawbacks and to meet all of the above mentioned conditions listed under (a) to (e).

These and other objects and advantages of the invention will appear more clearly from the following specification in connection with the accompanying drawings, in which.

The pressure valve according to the present invention for a rotary piston compressor, which valve is mounted in an axis-parallel passage of the housing mantle of the compressor is characterized primarily in that said valve has a cylindrical cross section and can be inserted through a side wall into a bore located in the housing mantle and provided behind the casing track, said bore being substantially parallel to the compressor axis. The pressure valve according to the invention is furthermore characterized in that the valve seat is formed by a longitudinally slotted tubular part which exerts a radially outwardly directed resilient force and which is provided with segmental slots extending parallel to the side walls of the compressor and forming valve openings. Valve lugs or tongues located above said slots are cut out of a relatively thin-walled tube located with precise fit in said tubular part while the roots of said valve tongues are connected to said tube which latter has an additional tube inserted therein with precise fit from which are cut the stroke limiting lugs or tongues located behind said valve tongues and curved toward the interior of said tube while having their roots connected to said tube.

The valve according to the invention can without difficulties be inserted from the outside into the machine housing and be attached by screw means from the outside, so that it can easily be replaced for repairs or for example when valve lugs are fractured. Furthermore it can easily be assembled by simple placing of individual tubular parts one inside the other. The production of the individual parts does not make necessary any special purpose manufacturing facilities.

Due to the curved surface, having the shape of a circular arc, of the valve seat, the passage in the casing through the hole receiving the valve can be smaller which results in improved strength of the housing casing and in more satisfactory cooling conditions.

Figure 1:
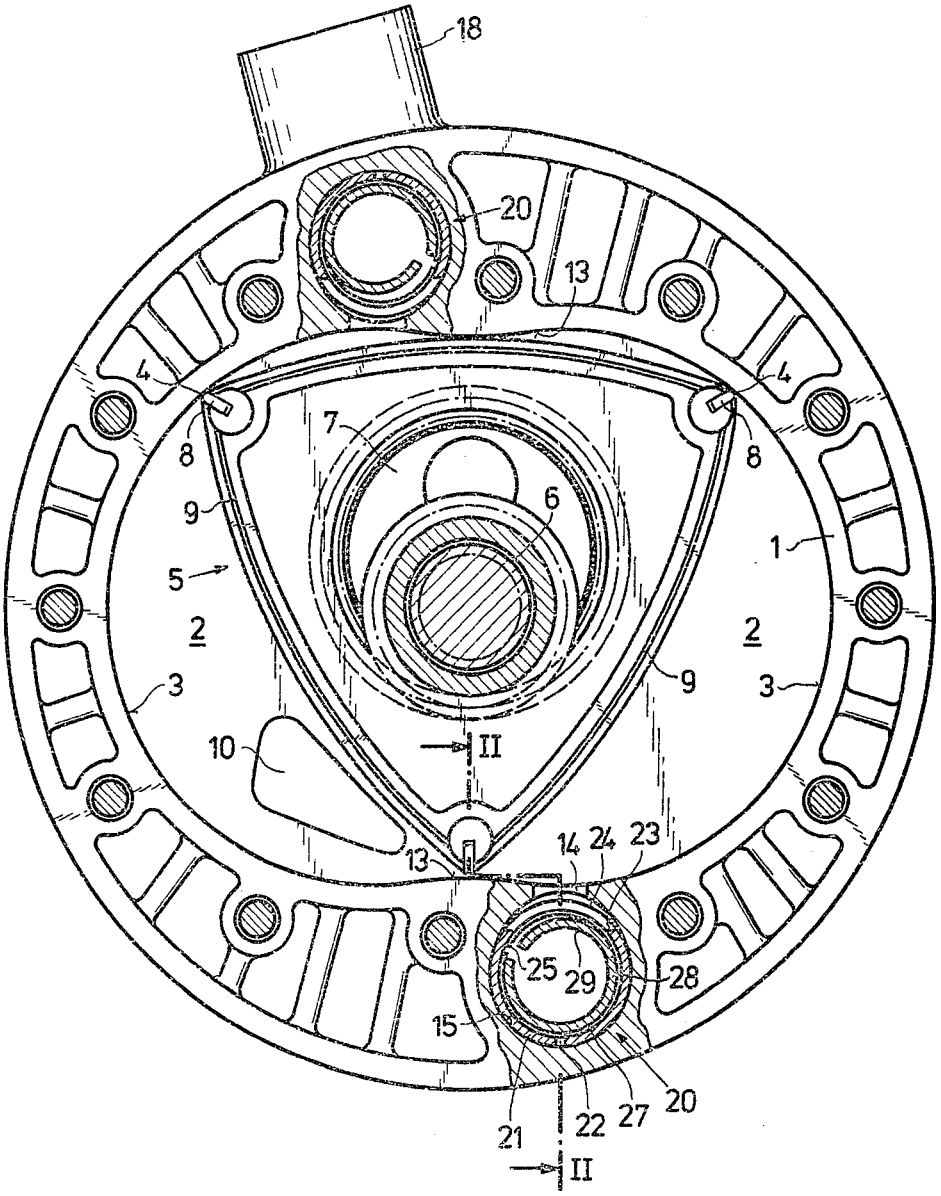
FIG. 1 illustrates partially in section and partially in side view a 2:3 ratio planetary rotation compressor of the trochoidal type with the overhead side wall removed.

Referring now to the drawings in detail, in FIG. 1 reference numeral 1 denotes the housing casing, while the rear side wall is denoted by the reference numeral 2. On the casing track 3 there slide the corners 4 of the triangular piston 5, which turns on the eccentric 7 turning about the shaft 6. The radial sealing strips of the piston are denoted by the reference numeral 8, while axial seals are denoted by the reference numeral 9. In the side wall 2 two inlet openings 10 are provided. On rotation of the piston 5 air is drawn in through the inlet openings, compressed and expelled via the valves in accordance with the invention.

Figure 2:
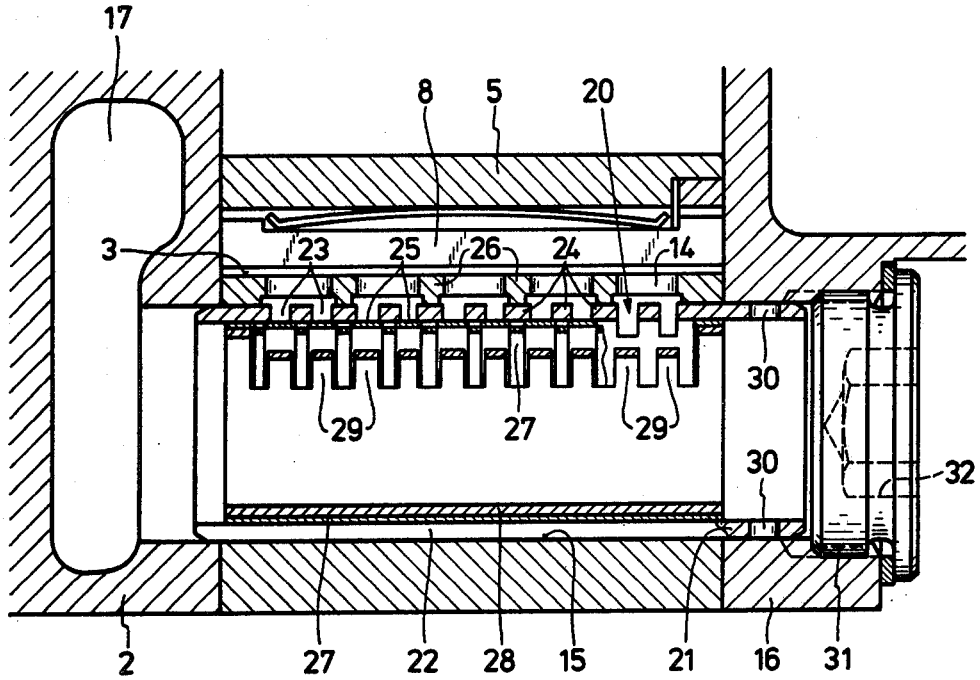
FIG. 2 is a partial section through the machine of FIG. 1 in the axial direction in the vicinity of the valve in accordance with the invention, said section being taken along the plane II—II of FIG. 1, but is on a larger scale than FIG. 1.

In terms of the direction or rotation of the piston ahead of the zones 13 near to the axis of the casing track 3 in the housing casing there are the outlet slots 14 running transversely with respect to this track. Behind these outlet slots, bores 15 are provided, which extend through the casing track in the direction parallel to the axis. They extend through the side wall 16 and open in the side wall 2 in an annular space 17 as shown in FIG. 2. This annular space is connected with the pressure pipe connector 18.

The two valves 20 of the machine shown are made identical so that they can be interchanged and, therefore, only one of them needs to be described.

In the bore 15 the tubular part 21 is inserted which forms the valve seat. Part 21 is slotted at 22 in the longitudinal direction and with a certain spring force presses against the wall of bore 15. At its side adjacent to the outlet opening 14 a series of segmental slots parallel to the side walls constitute the valve openings. The remaining edges, surrounding the slots 23, of the part 21 and the lands or webs 24 between the slots constitute the valve seats for the valve lugs 25. Each second land of the lands 24 is supported by lands or webs 26, which are arranged in the outlet slot 14 perpendicularly to its longitudinal direction. The valve lugs 25 are cut from a thin-walled tube 27, which is inserted into the tubular part 21 and lies precisely against its inner surface. A further tube 28 is inserted into the tube 27 with a close fit and, like the tube 21, has a thicker wall than the latter. From it the stroke limiting catching lugs 29 are cut, which are bent back towards the interior of the tube. The part 21 has at its end lying in the housing side wall two holes 30, by means of which it can be pulled out from the bore 15. At the outlet of the bore 15 in the side wall 2 a screw fitted lid 31 is fitted holding the valve 20 in the hole 15. The lid 31 can be tightened up by means of a hexagonal recess 32.

In contrast to previously proposed valves, the valve according to the invention can be readily fitted and removed again from the outside, that is to say from the side wall 16 without removing any other parts of the compressor itself, by actuating a single screw means. The cavity occupied by it in the housing casing and in the side parts does not impair either the strength or the cooling properties of the housing.

It is, of course, to be understood that the present invention is, by no means, limited to the specific showing in the drawings, but also comprises any modifications within the scope of the appended claims.

What we claim is:

1. In combination with a rotary piston compressor having a housing casing including side walls, a rotary piston rotatably mounted in said housing casing, and a track for engagement with and guiding said piston, said track being provided with an outlet, one of said side walls having a bore extending therethrough behind said outlet and being parallel to the axis of said compressor; a pressure valve having a substantially cylindrical cross section and being insertable into said compressor through said bore in said one side wall, a valve seat supporting said valve and including a longitudinally slotted tubular member exerting a radially outwardly directed force, said slotted tubular member comprising segmental valve opening slots extending substantially parallel to said side walls of said compressor, a thin-walled tube arranged with a precise fit in said tubular member and having valve tongues cut from said thin-walled tube and having their roots connected to said thin-walled tube, and an additional tube inserted with precise fit in said thin-walled tube and comprising stroke-limiting tongues located behind said valve tongues and curved toward the interior of said thin-walled tube, the roots of said stroke-limiting tongues being connected to said additional tube.

2. An arrangement according to claim 1, which includes screw connecting means provided in said one side wall of the compressor for connecting said pressure valve thereto.

3. An arrangement according to claim 1, in which said pressure valve has two lateral cross sectional openings and in which the pertaining side wall is provided with an annular chamber, said valve having said two lateral cross sectional openings leading into said annular chamber.

* * * * *